US006670928B1

(12) United States Patent
Chekroun et al.

(10) Patent No.: US 6,670,928 B1
(45) Date of Patent: Dec. 30, 2003

(54) ACTIVE ELECTRONIC SCAN MICROWAVE REFLECTOR

(75) Inventors: Claude Chekroun, Gif S/Yvette (FR); Jean-Paul Largent, Epinay S/Seine (FR)

(73) Assignee: Thales, Paris (FR)

( * ) Notice: Subject to any disclaimer, the term of this patent is extended or adjusted under 35 U.S.C. 154(b) by 0 days.

(21) Appl. No.: 10/130,276

(22) PCT Filed: Nov. 24, 2000

(86) PCT No.: PCT/FR00/03286

§ 371 (c)(1),
(2), (4) Date: May 28, 2002

(87) PCT Pub. No.: WO01/39325

PCT Pub. Date: May 31, 2001

(30) Foreign Application Priority Data

Nov. 26, 1999 (FR) ..... 99 14933

(51) Int. Cl.[7] ..... H01Q 19/06
(52) U.S. Cl. ..... 343/754; 343/909
(58) Field of Search ..... 343/754, 756, 343/786, 854, 909, 755, 753

(56) References Cited

U.S. PATENT DOCUMENTS

| | | | | |
|---|---|---|---|---|
| 4,212,014 A | * | 7/1980 | Chekroun | 343/754 |
| 4,320,404 A | * | 3/1982 | Chekroun | 343/854 |
| 4,344,077 A | * | 8/1982 | Chekroun et al. | 343/754 |
| 5,144,327 A | * | 9/1992 | Chekroun et al. | 343/731 |
| 5,598,172 A | | 1/1997 | Chekroun | 343/754 |

FOREIGN PATENT DOCUMENTS

| | | | | |
|---|---|---|---|---|
| FR | 2 708 808 | | 2/1995 | H03H/7/18 |
| FR | 2 747 842 | | 10/1997 | H01Q/3/46 |
| FR | 2 786 610 | | 6/2000 | H01Q/15/14 |
| GB | 2 280 988 A | * | 2/1995 | H01Q/3/46 |

* cited by examiner

*Primary Examiner*—Hoang V. Nguyen
(74) *Attorney, Agent, or Firm*—Oblon, Spivak, McClelland, Maier & Neustadt, P.C.

(57) ABSTRACT

An active electronic scan microwave reflector, capable of being illuminated by a microwave source to form an antenna. The reflector includes a set of elementary cells arranged side by side on a surface, each cell including a phase-shifting microwave circuit and a conductor plate arranged substantially parallel to the microwave circuit, the phase-shifting circuit including at least two half-phase-shifters. One half-phase-shifter includes at least a dielectric support, at least two electrically conductive wires substantially parallel to a given direction, arranged on the support and bearing at least a two-state semiconductor element, the conductors being substantially normal to the wires, and two conductor zones arranged towards the periphery of the cell, substantially parallel to the control conductors. The control conductors can be at least three in number in each half-phase-shifter and can be electrically insulated from one half-phase-shifter to the next to control the state of all the semiconductor elements independently from one another. The geometrical and electrical characteristics of the half-phase-shifters are such that each of the states of the semiconductor elements corresponds to a given phase-shifting value of the electromagnetic wave reflected by the cell. The reflector further includes an electronic circuit controlling the state of the semiconductor elements.

10 Claims, 7 Drawing Sheets

ACTIVE ELECTRONIC SCAN MICROWAVE REFLECTOR

Figure 1:
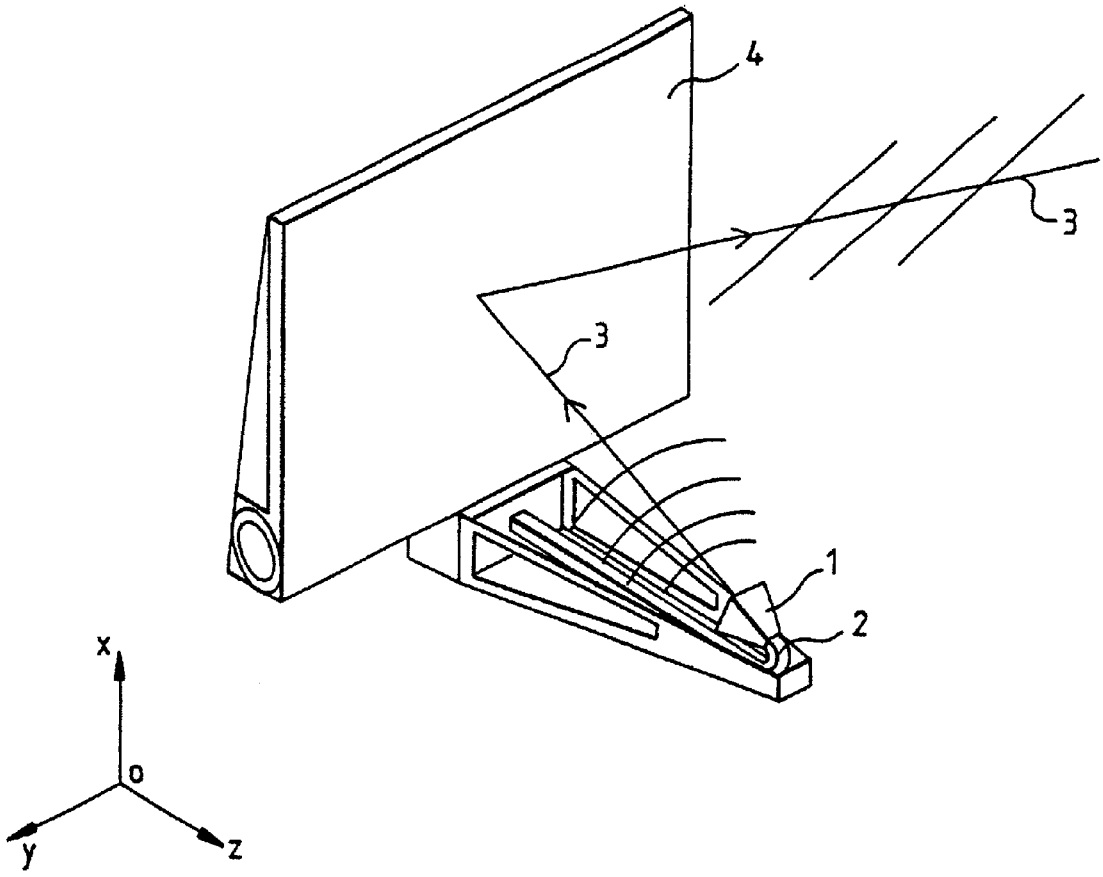

The present invention relates to an active microwave reflector with electronic scanning, capable of being illuminated by a microwave source in order to form an antenna.

It is known to produce antennas comprising an active microwave reflector. The latter, also called a "reflect array", is an array of phase shifters which can be controlled electronically. This array lies in a plane and comprises an array of elements with phase control, or a phased array, placed in front of the reflecting means, consisting, for example, of a metal ground plane forming a ground plane. The reflect array especially comprises elementary cells each one producing reflection and a phase shift, variable by electronic control, of the microwave that it receives. An antenna of this sort provides considerable beam agility. A primary source, for example a horn, placed in front of the reflect array emits microwaves toward the latter.

The phase shifts applied by the elementary cells vary discretely. Since the phase shifts are equally distributed, they are controlled digitally according to a number of bits. If this number is called N, the phase-shift step is then $2\pi/2^N$. The accuracy of a phase shift is therefore equal at best to one phase-shift step. The lack of accuracy leads to certain drawbacks, in particular it leads to the existence of relatively high secondary lobes and poor positioning accuracy of the antenna.

One aim of the invention is especially to alleviate the aforementioned drawbacks. To this end, the object of the invention is an active microwave reflector, capable of receiving an electromagnetic wave which is linearly polarized in a first given direction Oy. The reflector according to the invention comprises a set of elementary cells placed side by side over a surface, each cell comprising a phase-shift microwave circuit and a conducting plane placed substantially parallel to the microwave circuit, the phase-shift circuit comprising at least two half-phase shifters. A half-phase shifter comprises at least one dielectric support, at least two electrically conducting wires, substantially parallel to the given direction Oy, placed on the support and each one bearing at least one semiconducting element with two states, each wire being connected to conductors controlling the semiconducting elements, these conductors being substantially normal to the wires, and two conducting zones placed toward the periphery of the cell, substantially parallel to the control conductors. There are at least three control conductors in each half-phase shifter which are electrically insulated from one half-phase shifter to the other in order to control the state of all the semiconducting elements independently of each other. The geometrical and electrical properties of the half-phase shifters are such that a given phase-shift value ($d\phi_1, \ldots d\phi_8$) of the electromagnetic wave which is reflected by the cell corresponds to each of the states of the semiconducting elements. The reflector furthermore comprising an electronic circuit (36) for controlling the state of the semiconducting elements.

The invention also relates to an antenna fitted with such a reflector.

The main advantages of the invention is that it enables a low bulk and low weight reflector to be produced, that it is suitable for many types of antennas, that it improves heat exchange between the reflector circuits and the outside, that it provides great reliability and that it is economical.

Figure 2:
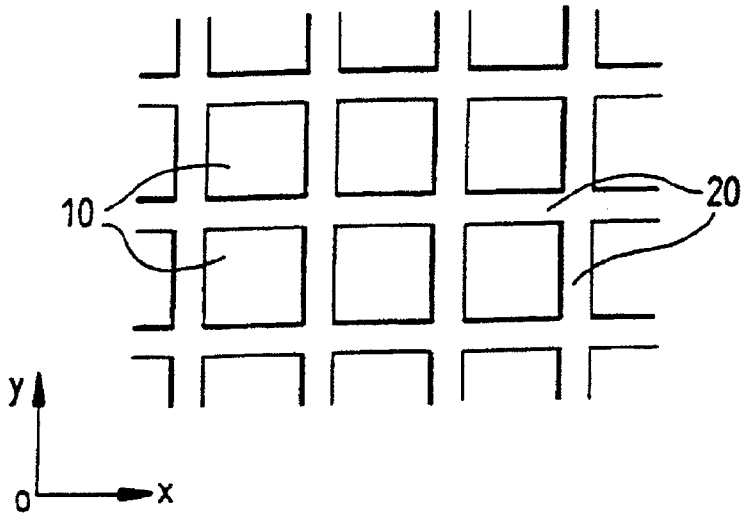
Figure 3:
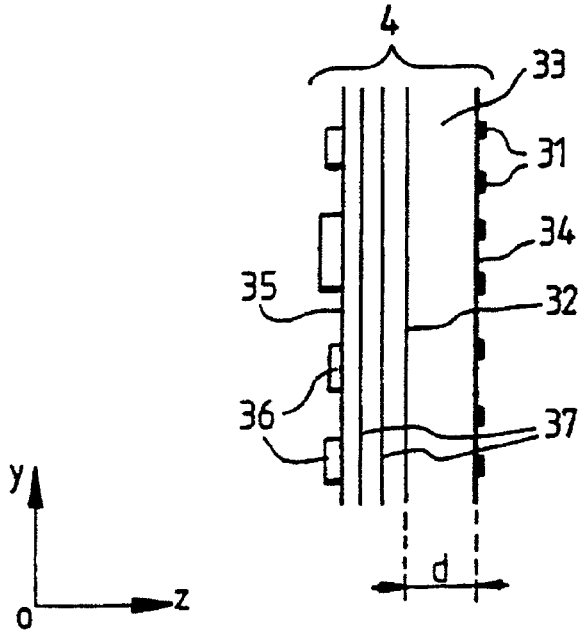
Figure 4:
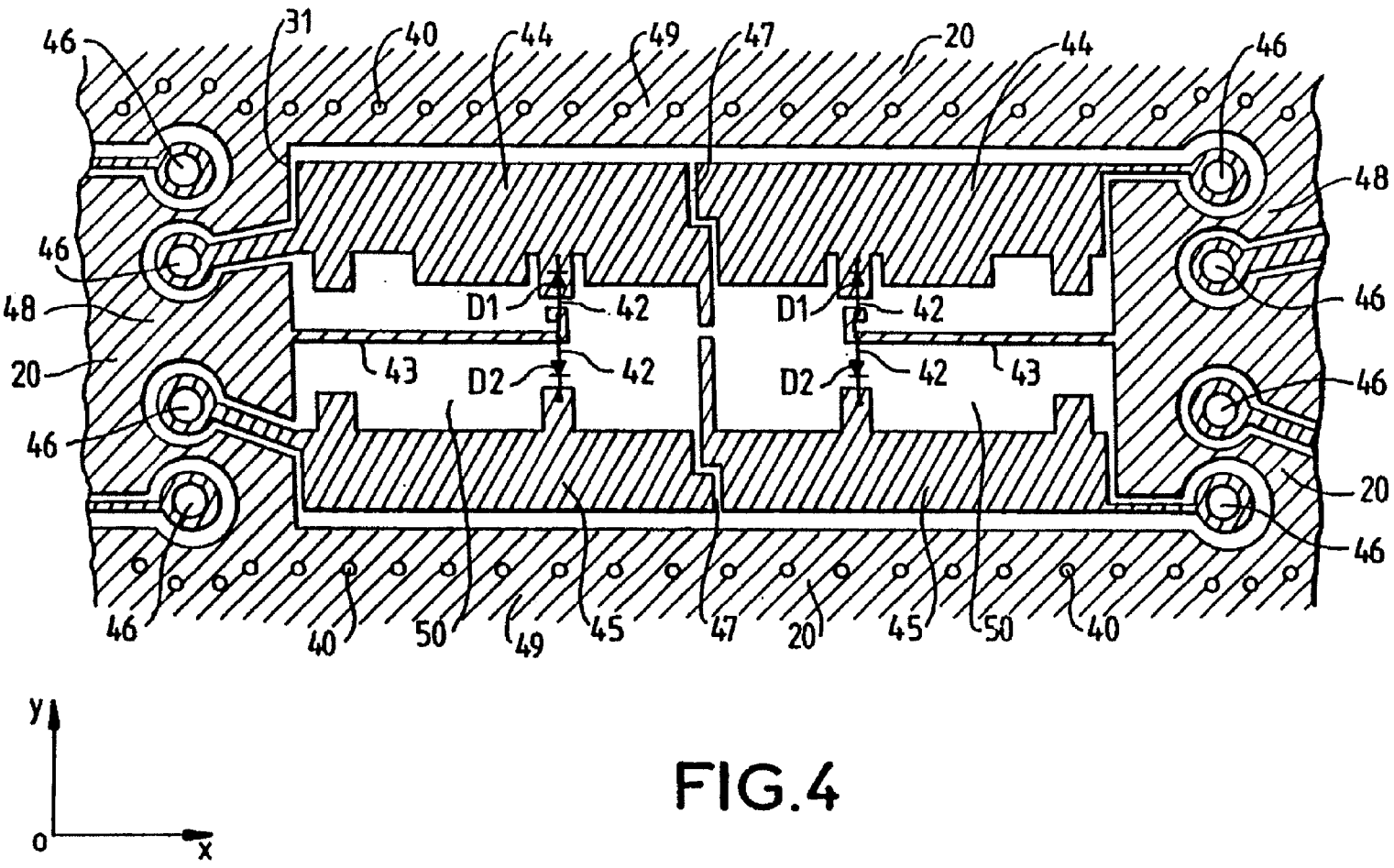
Figure 5:
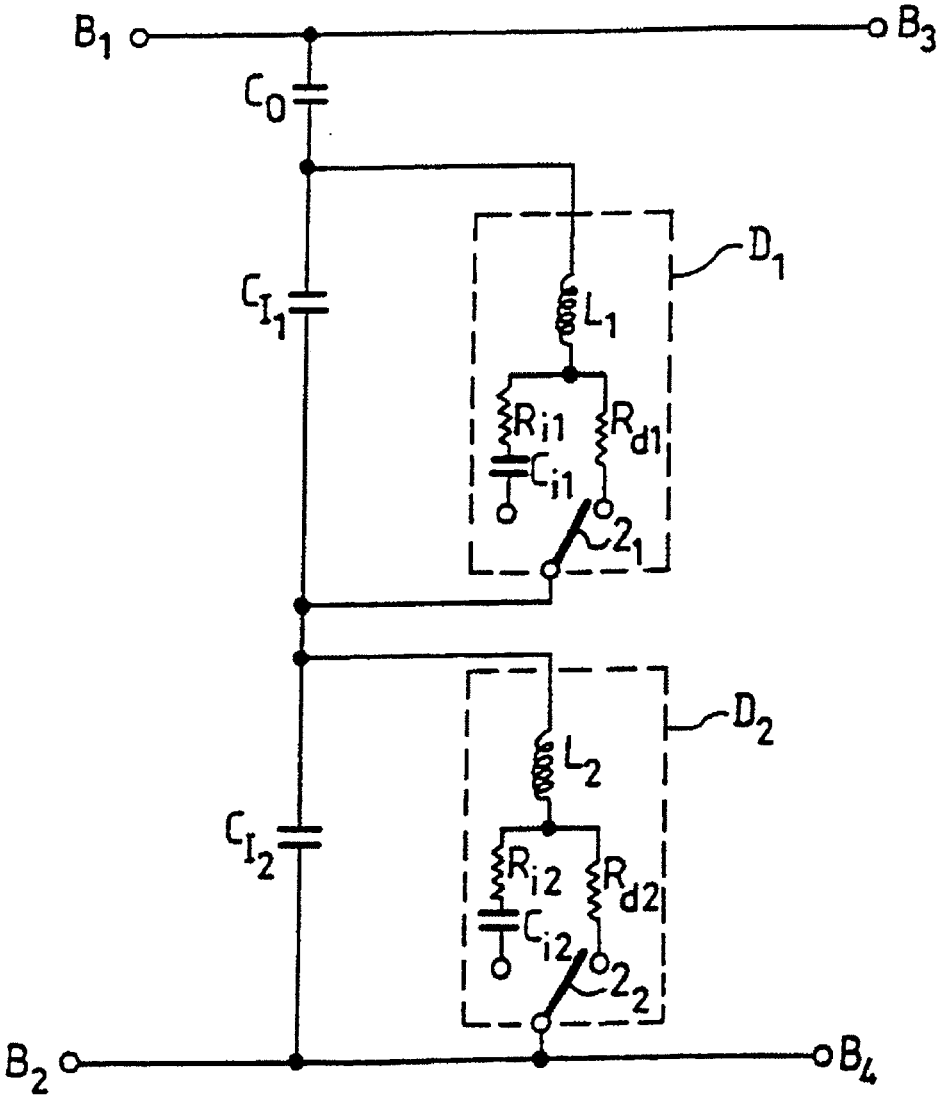
Figure 6:
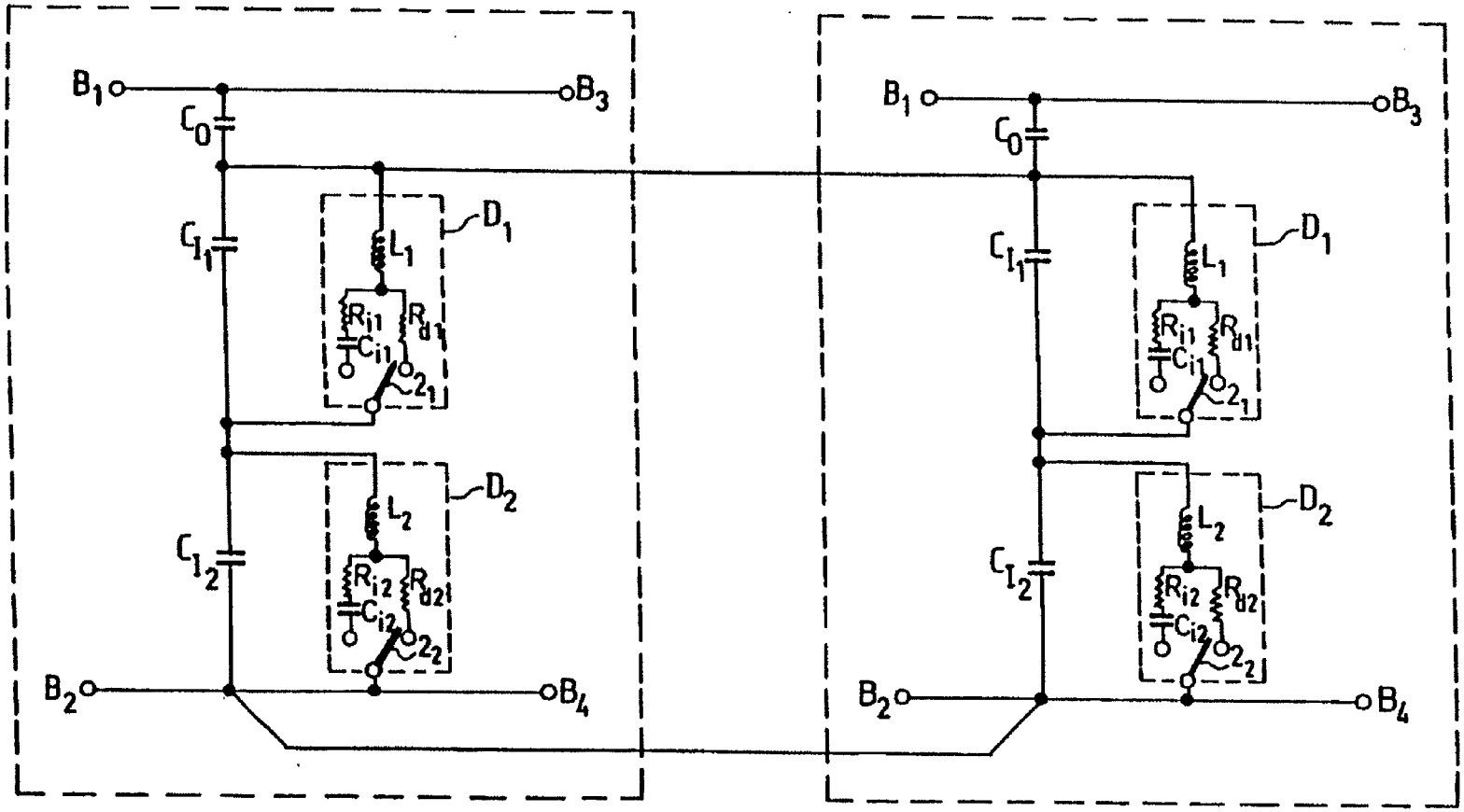
Figure 7:
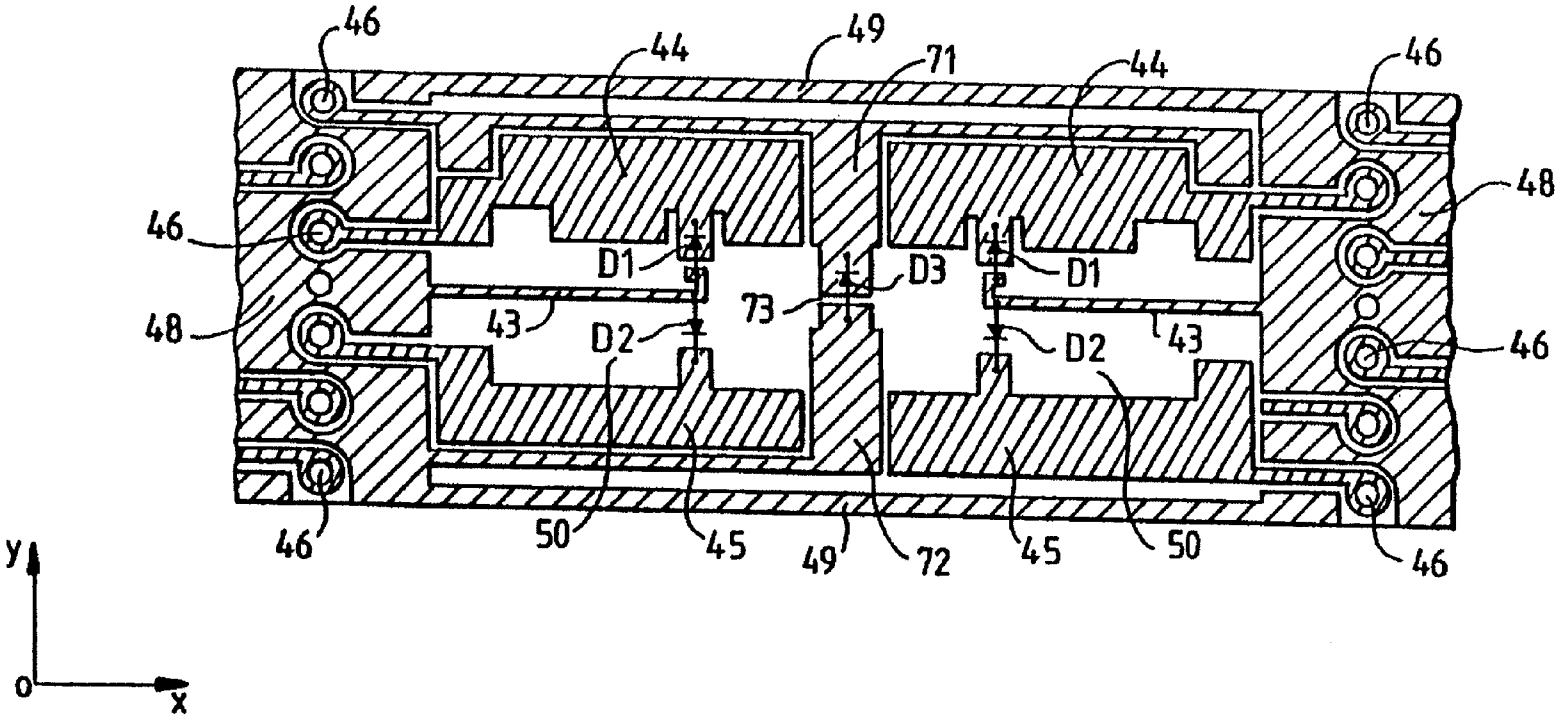
Figure 8:
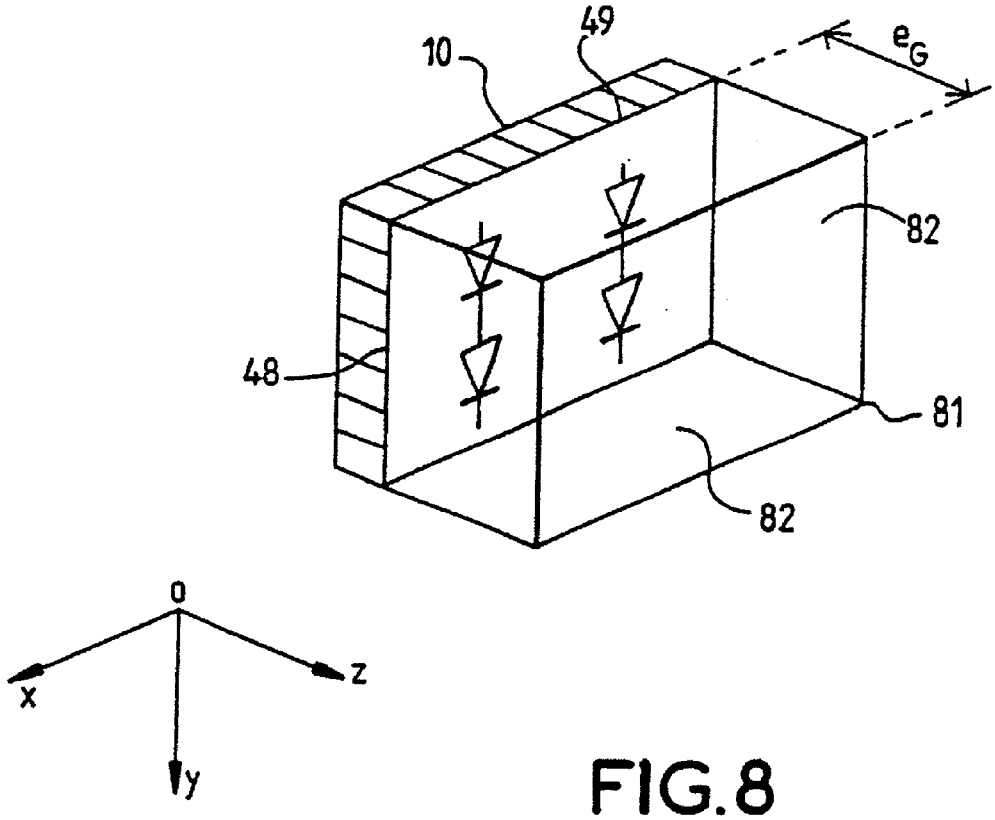

Other properties and advantages of the invention will become apparent using the following description made with reference to the appended drawings which show:

FIG. 1, an example of an electronic scanning antenna with an active microwave reflector with reference to a system of orthogonal axes Ox, y, z;

FIG. 2, a partial view of the front face of an exemplary active reflect array according to the invention;

FIG. 3, a partial view in section of an example of a reflector according to the invention;

FIG. 4, a first exemplary embodiment of an elementary cell of a reflector according to the invention;

FIG. 5, an equivalent circuit diagram of a half-phase shifter included in the aforementioned cell;

FIG. 6, an equivalent circuit diagram of the cell;

FIG. 7, a second possible exemplary embodiment of a reflector according to the invention;

FIG. 8, another exemplary embodiment of a reflector according to the invention comprising a lattice placed on the front face.

FIG. 1 schematically illustrates an exemplary embodiment of an electronic scanning antenna with an active reflect array where the microwave distribution is, for example, of the type called optical, that is to say, for example, provided using a primary source illuminating the reflect array. To this end, the antenna comprises a primary source 1, for example a horn. The primary source 1 emits microwaves 3 toward the active reflect array 4, placed in the plane Oxy. This reflect array 4 comprises a set of elementary cells producing reflection and a phase shift in the waves that they receive. Thus, by controlling the phase shifts impressed onto the wave received by each cell, it is possible, as is known, to form a microwave beam in the desired direction. Possibly, the reflector may be illuminated by more than one source. In particular, it may be illuminated by two elementary sources having, for example, reverse circular polarizations.

FIG. 2 shows schematically part of the reflect array 4 in the plane Oxy, by means of a top view, along F. The reflector comprises a set of elementary cells 10 placed side by side and separated by zones 20, used for the microwave decoupling of the cells. These cells 10 produce reflection and a phase shift in the waves that they receive. An elementary cell 10 comprises a phase-shift microwave circuit placed in front of a conducting plane. More specifically, as will become apparent below, the microwave circuit comprises two transverse phase shifters, each one dedicated to one linear polarization.

FIG. 3 is a schematic view in section, in the plane Oxz, of a possible exemplary embodiment of the active reflector 4. The reflector 4 consists of a microwave circuit 31 distributed in the elementary cells 10 and of a conducting plane 32, placed substantially parallel to the microwave circuit 31, at a predefined distance d. This microwave circuit receives the incident waves emitted by the primary source 1.

The conducting plane 32 especially has the function of reflecting the microwaves. It may consist of any known means, for example parallel wires or a lattice, which are sufficiently close, or a continuous plane. The microwave circuit 31 and the conducting plane 32 are preferably made on two faces of a dielectric support 33, for example of the printed circuit type. The reflector 4 further comprises, preferably on the same printed circuit 33, which is then a multilayer circuit, the electronic circuit needed to control the phase values. In FIG. 3, a multilayer circuit is shown, the front face 34 of which bears the microwave circuit 31, the rear face 35 of which bears the components 36 of the aforementioned electronic control circuit, and the intermediate layers of which form the conducting plane 32 and for example two planes 37 for interconnecting the components 36 to the microwave circuit 31.

FIG. 4 shows, by means of a top view, a possible exemplary embodiment of the microwave circuit 31 of a reflector according to the invention. More particularly, FIG. 4 illustrates an elementary phase shifter 31 for the microwave circuit. Each phase shifter is separated from another phase shifter by a decoupling zone 20 comprising, for example, a conducting strip 48 parallel to the direction Oy and a conducting strip 49 parallel to the direction Ox. It therefore comprises, for example at its periphery, two conducting strips 48 in the direction Oy and two conducting strips in the direction Ox. Each elementary phase shifter 31, combined with the corresponding part of the conducting plane 32, forms an elementary cell 10 of FIG. 2.

The microwave circuit of a phase shifter 31 comprises several conducting wires 42 substantially parallel to the direction Oy and each bearing a semiconducting element D1, D2 with two states, for example a diode. The phase shift circuit moreover comprises conducting zones connecting the diodes to reference potentials and control circuits. More particularly, an elementary phase shifter 31 consists of two circuits 50, subsequently called a half-phase shifter. A half-phase shifter will therefore be described first of all.

A half-phase shifter 50 comprises a dielectric support 33, two wires 42, each one bearing a diode D1, D2. The two wires are connected to the ground potential, or to any other reference potential, via a conducting line 43. This line 43 is, for example, of the microstrip type produced by a metal coating on the front face of the dielectric support 33, for example by means of a screen-printing technique. The diodes D1 and D2 are thus wired in opposition such that, for example, their anodes are connected to the ground potential by means of this line 43. To this end, the latter is for example connected to a conducting strip 48 of the decoupling means 20. The supply voltage of the diodes D1 and D2 is provided by control conductors 44. Since the anode of the diodes is connected to the ground potential, the control conductors are then connected to the cathode of the diodes. The supply voltage provided by these conductors is, for example, about −15 volts. The control conductors are controlled so as to provide at least two voltage states. In a first state, their voltage is, for example, at the supply voltage, which switches the diode on, or in other words makes it forward biased. In a second state, their voltage is such that the diode is switched off, or in other words, reverse biased. The controls of the two control conductors 44, 45 are independent of each other so as to control the diodes independently of each other. The control conductors 44, 45 and the conductor 43 connected to ground are substantially parallel to the direction Ox and therefore perpendicular to the wires 42. In FIG. 4, the ground conductor is common to the two wires in particular to save in size and material, however a special conductor could be provided for each wire. Moreover, it would be possible to connect these conductors, not directly directly to a reference potential, but via a control circuit.

The control conductors 44, 45 are connected to the electronic control circuit borne by the reflector, via plated-through holes 46 made, for example, in the decoupling zone 20, in particular for reasons of size, but also in order not to disturb the operation of the elementary cells. The plated-through holes 46 are of course electrically insulated from the conducting strips of the decoupling zone. To this end, the strip 20 is interrupted around the ends of the control conductors directly connected to the plated-through holes 46.

In order to describe the operation of a half-phase shifter 50, it is necessary to consider its equivalent circuit as shown in FIG. 5. The equivalent circuit relates to the conducting wires 42 and the two diodes D1, D2, which actually corresponds to a half-phase shifter, combined with a given polarization and therefore with a given frequency band. The incident microwave, of linear polarization parallel to Oy and to the wires 42, is received on the terminals $B_1$ and $B_2$ and encounters three capacitors $C_o$, $C_{I1}$, $C_{I2}$ in series, connected in parallel to the terminals $B_1$ and $B_2$. The capacitance $C_o$ represents the linear decoupling capacitance between the control conductors 44 and the conducting strip of the decoupling zone 20. The capacitance $C_{I1}$ is the linear capacitance between the control conductor 44 connected to the first diode D1 and the ground conductor 43. The capacitance $C_{I2}$ is the linear capacitance between the control conductor 45 connected to the second diode D2 and the central conductor 43.

The first diode D1, also represented by its equivalent circuit diagram, is connected to the terminals of the capacitor $C_{I1}$. This equivalent circuit diagram consists of an inductor $L_1$, the inductance of the diode D1 including its connection wire 42, in series with:

- either a capacitor $C_{i1}$ (junction capacitance of the diode) in series with a resistor $R_{i1}$ (reverse resistance),
- or a resistor $R_{d1}$ (forward resistance of the diode), depending on whether the diode D1 is reverse or forward biased, which is symbolized by a switch $\mathbf{2}_1$.

In the same way, the terminals of the capacitor $C_{I2}$ are connected to the second diode D2 shown by its equivalent circuit diagram. The latter is similar to that of the first diode D1, its components bearing an index 2.

The microwave output voltage is taken from the terminals $B_3$ and $B_4$, the terminals of the capacitors $C_0$, $C_{I1}$, and $C_{I2}$.

The operation of the half-phase shifter 50 is explained below by considering, in a first step, the behavior of such a circuit in the absence of the second diode D2, which amounts to removing D2 and the capacitor $C_{I2}$ from the equivalent circuit diagram of FIG. 5.

When the first diode D1 is forward biased, the susceptance $B_{d1}$ of the circuit of the (modified) FIG. 5 is written:

$$b_{dI} = Z \cdot C_0 \cdot \omega \cdot \frac{1 - L_1 C_{II} \omega^2}{L_1 C_{II} \omega^2 + L_1 C_0 \omega^2 - 1} \tag{1}$$

where Z is the impedance of the incident wave and ω is the angular frequency corresponding to the central frequency of one of the two operating bands of the antenna.

The parameters of the circuit can be chosen, for example, so that $B_{d1} \equiv 0$, that is to say that, by neglecting its conductance, the circuit is matched or, in other words, that it is transparent to the incident microwave, introducing neither a parasitic reflection, nor a phase-shift ($d\phi_{d1}=0$). More specifically, the following is chosen:

$$L_1 C_{11} \omega = 1$$

which leads to $B_{d1} \equiv 0$, whatever the value of the capacitance $C_{i1}$.

When the first diode D1 is reverse biased, the susceptance $B_{r1}$ of the circuit is written:

$$B_{rI} = Z \cdot C_0 \cdot \omega \cdot \frac{1 - L_1 C_{II} \omega^2 + (C_{II} / Ci)}{L_1 C_{II} \omega^2 + L_1 C_0 \omega^2 - 1 + \dfrac{C_0 + C_{II}}{C_i}} \tag{2}$$

Since the capacitance $C_{I1}$ is set beforehand, it appears that it is possible to adjust the value of the susceptance $B_{r1}$ by changing the value of the capacitance $C_i$, that is to say by choosing the diode D1.

If now, in a second step, the existence of the second diode D2 is taken into consideration, it can be seen that, by means of similar reasoning, two other distinct values are obtained for the susceptance, depending on whether the diode D2 is forward or reverse biased.

Thus it appears that a half-phase shifter may have four different values for its susceptance $B_D$, these values being called $B_{D1}$, $B_{D2}$, $B_{D3}$ and $B_{D4}$, depending on the control (forward or reverse biased) applied to each of the diodes D1, D2. The values of the susceptances $B_{D1}$, $B_{D2}$, $B_{D3}$ and $B_{D4}$ depend on the parameters of the circuit of FIG. 5, that is to say on the values chosen for the geometrical parameters, especially with regard to the dimensions, shapes and spacing of the various conducting surfaces 43, 44, 45 and electrical parameters of the phase shifter, especially with regard to the electrical properties of the diodes. In particular, it is necessary to take account of the restriction in defining the conducting band of the decoupling zone 20 mentioned above while determining the various parameters for setting the phase shifts $d\phi_1$–$d\phi_4$.

If, now, the behavior of the entire half-phase shifter 50 is studied in combination with the conducting plane 32, account must be taken of the susceptance due to this plane 32, brought into the plane of the half-phase shifter and called $B_{CC}$, which is written:

$$B_{CC} = -\text{cotg}\frac{2\pi d}{\lambda} \tag{3}$$

where $\lambda$ is the wavelength corresponding to the previous pulse $\omega$.

The susceptance $B_C$ of the cell is then given by:

$$B_C = B_D + B_{CC} \tag{4}$$

It follows that the susceptance $B_C$ may take four different values (called $B_{C1}$, $B_{C2}$, $B_{C3}$ and $B_{C4}$) corresponding respectively to the four values of $B_D$, the distance d representing an additional parameter for determining the values $B_{C1}$–$B_{C4}$.

It is also known that the phase-shift $d\phi$ impressed by an admittance Y onto a microwave has the form:

$$d\phi = 2 \text{ arctg } Y \tag{5}$$

It thus appears that, by neglecting the real part of the admittance of a cell, we have:

$$d\phi = 2 \text{ arctg } B_C \tag{6}$$

and that four possible values $d\phi_1$–$d\phi_4$ of the phase shift are obtained for each half-phase shifter 50, depending on the control applied to each of the diodes $D_1$ and $D_2$. The various parameters are chosen so that the four values $d\phi_1$–$d\phi_4$ are equally distributed, for example but not necessarily: 0, 90°, 180°, 270°. These four states correspond to a digital command coded on two bits.

It should be noted that the case has been described above, in which the parameters of the circuit are chosen so that the zero (or almost zero) susceptances are such that they correspond to the diodes biased in the forward direction, but that of course it is possible to choose a symmetrical operation in which the parameters are determined in order to substantially cancel the susceptances $B_r$; more generally, it is not necessary that one of the susceptances $B_d$ or $B_r$ be zero, these values being determined so that the condition of equal distribution of the phase shifts $d\phi_1$–$d\phi_4$ is fulfilled.

In order to show how an elementary cell 10 allows eight possible phase shifts, that is to say control of the phase shifts over three bits, both of the two half-phase shifters 50 will now be considered. By making the two half-phase shifters 50 operate independently of each other, twice as many states can be obtained, that is to say twice as many phase shifts as in the case of a single half-phase shifter. However, for this it is necessary to provide electrical insulation between the two half-phase shifters. Since the latter are for example juxtaposed, the control conductors 44, 45 are insulated, for example by a dielectric line 47, in fact corresponding to a cut line in the metallization of the conductors 44, 45. This first insulation in fact allows the electrical controls of the diodes to be insulated.

FIG. 6 shows an equivalent circuit diagram of the entire phase shifter consisting of two half-phase shifters as described above. It may be considered that the equivalent circuit diagrams of the two half-phase shifters 50, as shown in FIG. 5, operate in parallel. This is because the capacitive links between the control conductors 44 of the diodes D1 and between the control conductors 45 of the diodes D2 may be likened to microwave short circuits. The length and width of the insulation line 47 may be varied to obtain a value of capacitance between the conductors which makes it possible to liken the capacitive link to a short circuit. For circuits in parallel, the susceptances are added. Hence, in addition to the four susceptance values $B_{D1}$, $B_{D2}$, $B_{D3}$, $B_{D4}$ obtained by the influence of a half-phase shifter, four new values $B'_{D1}$, $B'_{D2}$, $B'_{D3}$, $B'_{D4}$ are obtained by the influence of the second phase shifter.

The geometrical and electrical parameters of the phase shifter are, for example, defined in order to obtain eight phase shifters equally distributed between 0° and 360°.

The geometrical parameters which especially relate to the dimensions, the shapes and the spacing of the various conducting surfaces 44, 45, 33 vary the values of the capacitances and inductances of the equivalent circuit diagram of FIGS. 5 and 6, summarized in equations (1) and (2). Depending on the phase shifts desired, susceptance values $B_C$ and therefore susceptance values $B_D$ are defined according to equations (3) and (4), the distance d being known. Since the values of the susceptances $B_D$ are imposed, the values of the parameters of equations (1) and (2) are then deduced therefrom. The geometrical and electrical parameters of the phase shifter may then be obtained by conventional simulation means. FIG. 4 shows that the conducting surfaces 44, 45, 43 have particular shapes. The control conductors 44, 45 especially have crenellated surfaces. These surfaces correspond to previously defined phase shift values.

A phase shifter as illustrated in FIG. 4 is simple to implement, in fact it enables eight phase shifts to be obtained simply by varying the geometrical parameters of conductors and the choice of diodes. The printed circuit supporting the microwave circuits and the electronic control circuits is also not very thick. Such a circuit may be obtained economically and the reflector may therefore be extremely flat, and therefore of low weight.

As was indicated above, an active reflector according to the invention comprises decoupling means 20 between the cells 10. The microwave received by the cells is linearly polarized, parallel to the direction Oy. It is desirable that this wave does not propagate from one cell to another, in the direction Ox. In order to prevent such propagation, the decoupling means comprise at least the conducting zone 48. Provision is therefore made to arrange this conducting zone 48, substantially in the form of a strip, made by metal deposition on the surface 34 for example, between the cells, parallel to the direction Oy. This strip 48 forms, with the reflecting plane 32 which is therebelow, a space of the waveguide type whose width is the distance d. The distance d is chosen so that it is less than $\lambda/2$, where $\lambda$ is the microwave wavelength, knowing that a wave whose polarization is parallel to the strips cannot be propagated in such a space. In practice, the reflector according to the invention operates within a certain frequency band and d is chosen so that it is less than the smallest wavelength of the band. Of course, it is necessary to take into account this constraint when determining the various parameters for setting the phase shifts $d\phi_1, \ldots d\phi_8$. Furthermore, the strip 48 must have a width, in the direction Ox, which is enough for the effect described above to be appreciable. In practice, the width may be about $\lambda/5$.

Moreover, a parasitic wave, whose polarization would be directed in the direction Oz, perpendicular to the plane formed by the directions Ox and Oy, may be created in a cell. It is also desirable to prevent its propagation toward the neighboring cells.

With regard to the neighboring cells in the direction Ox, the plated-through holes 46 for connecting the control conductors to the electronic circuits may be used, as shown in FIG. 4. This is because, since the electronic circuits are parallel to the polarization of the parasitic wave, they are equivalent to a conducting plane forming a shield if they are close enough (at a distance from each other which is much less than the operating wavelength of the reflector), therefore numerous, for the operating wavelengths of the reflector. If this condition is not fulfilled, additional plated-through holes can be formed, not having a connection function. It should be noted that the plated-through connection holes 46 are preferably made in the strips 48 so as not to disturb the operation of the cells. Moreover, this arrangement provides a saving in size.

Finally, with regard to the neighboring cells in the direction Oy, plated-through holes 40 similar to the connection holes 46 but aligned in the direction Ox opening into the conducting strip 49, may be used. These plated-through holes 40, as with the connection plated-through holes 46, are made in a direction Oz substantially perpendicular to the plane Oxy. A conducting surface which is continuous in the plane xOz could, for example, also be provided.

FIG. 7 illustrates a phase shifter according to the invention allowing the phase shifts to be controlled over four bits, therefore over an additional bit with respect to the phase shifter illustrated in FIG. 4. The phase shifter still comprises two half-phase shifters 50 made as described above. However, the two half-phase shifters are no longer separated by a line 47 insulating the controls from the diodes, but by two conducting zones 71, 72 connected by a diode D3, or any other semiconductors with two states. These two zones 71, 72 are, for example, made by metal deposition on the front face 34 of the dielectric. These zones form conductors controlling the diode D3. To this end, a conducting zone 71 is for example connected to the electronic control circuits via a plated-through hole 46. Depending on the state of the electronic control, this zone 71 is at a supply potential, for example −15 volts or at another potential, for example the ground potential. The other conducting zone 72 is for example connected to the ground potential. To this end, it is for example connected to the conducting strip 48 parallel to the direction Oy of the decoupling means 20.

When the conducting zone 71 is controlled in order to be at the ground potential, or more generally, in order to switch off the diode D3, that is to say in reverse bias, the phase shifter is similar to that of FIG. 4, in this state it has eight possible phase shifts. It is of course necessary to redefine its geometrical and electrical parameters because of the introduction of additional zones 71, 72. When the conducting zone 71 has a potential which switches on the diode D3, that is to say puts it in forward bias, the electrical parameters of the phase shifter are modified compared with the previous state. In particular, the capacitance formed in the space between the two conducting zones 71, 72 becomes short circuited by the diodes D3. The eight possible susceptances of the previous state, controlled over three bits, are then modified by making the diode D3 conducting. The eight new susceptances thus obtained enable eight additional phase shifts to be obtained. In total, 16 phase shifts are therefore possible. The geometrical and electrical properties of the two half-phase shifters 50 and also of the additional conducting zones 71, 72 and of their diode D3 have to be defined so as to obtain the 16 phase shifts desired for each of the states of the diodes.

FIG. 8 illustrates a possible variant embodiment of a reflector according to the invention, the elementary cells 10 being, for example, of the type shown by FIG. 4 or 7. In this embodiment, a metal grid is placed over the front face of the reflector, that is to say the face which faces the microwave source 1. This lattice is made up of gridcells 81, each one having the surface area of an elementary cell, more particularly, the base of a gridcell surrounds a cell. Moreover, the lattice has a thickness $e_G$.

To illustrate the arrangement of this grid with respect to the elementary cells 10 of the reflector, FIG. 8 presents in perspective a single elementary cell. The grid is made up of gridcells, the walls 82 of which lie in the direction Oz, substantially facing the conducting strips 48, 49 of the decoupling means 20. In particular, the base of the grid is in contact with these strips 48, 49 and especially with the plated-through holes 40, 46 which the strips comprise. The thickness $e_G$ of the grid, which in fact corresponds to the length of the walls 82, is for example about a centimeter, preferably about half a centimeter. The relatively low thickness of the lattice therefore makes it possible to keep a reflector which is very flat, and therefore of low weight.

This metal grid enables the phase shift function to be decoupled from the radiation function, and enables the active coupling coefficients to be controlled by rendering them independent of the positioning law for the antenna and thus enables the parasitic radiation lobes, such as the image lobe and the magicity lobes to be cancelled out.

Moreover, the metal lattice, which in particular is in contact with the plated-through holes, allows better heat exchange between the circuits of the reflector and the outside by virtue of a larger exchange surface area. The reliability of the reflector is therefore increased.

An active reflect array according to the invention may be used for many types of antennas. In particular, it may be used for spatial communication antennas by virtue of its low weight or else be used for meteorological radar antennas by virtue of its low cost. Finally, it may be used for all types of antennas with a reflector in applications requiring high positioning accuracy and a low level of secondary lobes.

What is claimed is:

1. An active microwave reflector, configured to receive an electromagnetic wave linearly polarized in a first direction, comprising:

a set of cells placed side by side over a surface, each cell comprising a phase-shift microwave circuit and a conducting plane placed substantially parallel to the microwave circuit; and a metal grid formed by gridcells, wherein walls of the gridcells lie in a direction perpendicular to the plane of the reflector, a base of one gridcell surrounding a cell, wherein each phase-shift microwave circuit comprises at least two adjacent half-phase shifters, at least one dielectric support, and a control circuit, the two adjacent half-phase shifters being supported on the at least one dielectric support and each including at least two electrically conducting wires arranged substantially parallel to the first direction connected with at least one semiconducting element with two states, each of the at least two electrically conducting wires also being connected with a respective one of two control conductors connected to the control circuit, the two control conductors being arranged to extend in a direction substantially normal to a direction of extension of the at least two electrically conducting wires, each phase-shift microwave circuit further including two peripheral conducting zones placed toward a periphery of the cell that extend in a direction substantially parallel to the two control conductors, the two control conductors and connected control circuit being configured to control the state of the at least one semiconducting element with two states in each of the at least two adjacent half-phase shifters independently of each other, geometrical and electrical properties of the two adjacent half-phase shifters being such that a given phase-shift value of the electromagnetic wave being received is reflected by the cell.

2. The reflector as claimed in claim 1, wherein the two adjacent half-phase shifters are separated by two further conducting zones connected by a further semiconducting element with two states, at least one of the two further conducting zones being connected to the control circuit also being configured to control the state of the further semiconducting element as well as the states of each semiconducting element in each of the two adjacent half-phase shifters such that a given phase-shift value of the electromagnetic wave reflected by the cell corresponds to each of the states of the respective controlled semiconducting elements.

3. The reflector as claimed in claim 1, wherein the dielectric support comprises a multilayer printed circuit including a first face that bears the microwave circuit, a first intermediate layer that bears the conducting plane, and a second face that bears components of the control circuit.

4. The reflector as claimed in claim 3, wherein the dielectric support further comprises at least a second intermediate layer bearing interconnects of the control circuit.

5. The reflector as claimed in claim 1, further comprising plated-through holes made in the dielectric support, in a direction perpendicular to a plane of the reflector, at a distance one from the other less than the electromagnetic wavelength, at least one of the plated-through holes providing a link between the control circuit and the two control conductors.

6. The reflector as claimed in claim 5, wherein the plated-through holes emerge on the conducting strips placed at the periphery of a cell.

7. The reflector as claimed in claim 1, wherein the semiconducting elements comprise diodes.

8. The reflector as claimed in claim 1, wherein a third control conductor is provided in each half-phase shifter.

9. A microwave antenna with electronic scanning, comprising a reflector according to claim 1 and a microwave source illuminating the reflector.

10. The reflector as claimed in claim 1, further comprising:

a conducting strip placed between each cell in a direction parallel to the first direction that forms, with the conducting plane, a guided space where the electromagnetic wave cannot be propagated.

* * * * *